US005099570A

United States Patent [19]

Gerhard, Jr.

[11] Patent Number: 5,099,570

[45] Date of Patent: Mar. 31, 1992

[54] SELF ALIGNING INSERTER

[75] Inventor: George H. Gerhard, Jr., Laureldale, Pa.

[73] Assignee: AMP Incorporated, Harrisburg, Pa.

[21] Appl. No.: 722,636

[22] Filed: Jun. 27, 1991

[51] Int. Cl.[5] ..... H01R 43/01

[52] U.S. Cl. ..... 29/751; 29/753; 29/866

[58] Field of Search ..... 29/750–753, 29/863, 866

[56] References Cited

U.S. PATENT DOCUMENTS

| | | | |
|---|---|---|---|
| 3,742,571 | 7/1973 | Brehm | 29/203 |
| 3,760,335 | 9/1973 | Roberts | 339/99 |
| 4,389,769 | 6/1983 | Casey | 29/753 |
| 4,575,932 | 3/1986 | Joos et al. | 29/751 |
| 4,967,470 | 11/1990 | Folk | 29/747 |

OTHER PUBLICATIONS

AMP IS 9414 "AMP Terminating Head 58063-2 for AMPLIMITE", pp. 2-6 released 4/26/88.

AMP IS 9085 "AMP Terminating Head 58062-1 for AMPMODU", pp. 7-13 released 4/22/85.

*Primary Examiner*—P. W. Echols

*Attorney, Agent, or Firm*—James M. Trygg

[57] ABSTRACT

A hand tool for inserting wires into insulation displacement contacts contained within a plastic connector housing is disclosed. An alignment member is provided which has a pair of camming surfaces formed on opposite sides thereof. The alignment member is attached to and moves with the insulation crimping blade and the wire insertion blade during the insertion process. The camming surfaces are arranged to engage the walls of the connector housing on either side of the contact and precisely align the contact with the insertion blade and crimping blade by moving the connector housing as needed just prior to engagement of the insertion blade and crimping blade.

5 Claims, 5 Drawing Sheets

SELF ALIGNING INSERTER

The present invention relates to hand tools for inserting wires into insulation displacement contacts contained within a connector housing, and more particularly to a self-aligning inserter therefor.

BACKGROUND OF THE INVENTION

Connectors having insulation displacement contacts (IDC) are widely used in the telephone and computer industries as well as many other industries. U.S. Pat. No. 3,820,055 which issued June 25, 1972 to Hufnagle discloses such IDC connectors in detail. Occasionally, a connector becomes damaged during use and must be repaired or replaced. To do this, portable hand tools have been developed to permit removal of a damaged IDC connector from a cable and subsequent retermination of the wires contained in the cable to a new replacement connector. An example of such a hand tool is disclosed in U.S. Pat. No. 3,742,571 which issued July 3, 1973 to Brehm. Such hand tools are designed for use with rather large connectors having substantial space between contacts so that the insulation crimping blade has sufficient room to enter between the walls of the housing that are adjacent the contact on either side without damaging these walls. However, with more closely spaced contacts where the contacts are very close to the adjacent walls of the connector housing, it is difficult to insert the insulation crimping blade between the walls during insertion of the wire without damaging the walls. This problem arises due to slight misalignment of the connector housing within the hand tool or due to a slight warping or bowing of the connector housing walls.

What is needed is an inexpensive but effective guide means for precisely aligning a selected contact within the connector housing with the crimping and insertion blades so that the walls of the connector housing are not damaged.

SUMMARY OF THE INVENTION

The present invention is an apparatus for inserting an insulated wire into an insulation displacement contact in a connector housing. The apparatus is arranged to accurately align the connector housing so that the insertion blade is in alignment with a selected contact. The apparatus includes a track for receiving the connector housing, inserter means for inserting the wire into the contact and means for initially positioning the housing so that the contact is in approximate alignment with the inserter means. An alignment means is provided for further positioning the housing so that the contact is in engageable alignment with the inserter means and the housing remains substantially free of engagement with the inserter means during insertion of the wire into the contact.

DESCRIPTION OF THE PREFERRED EMBODIMENT

Figure 1:
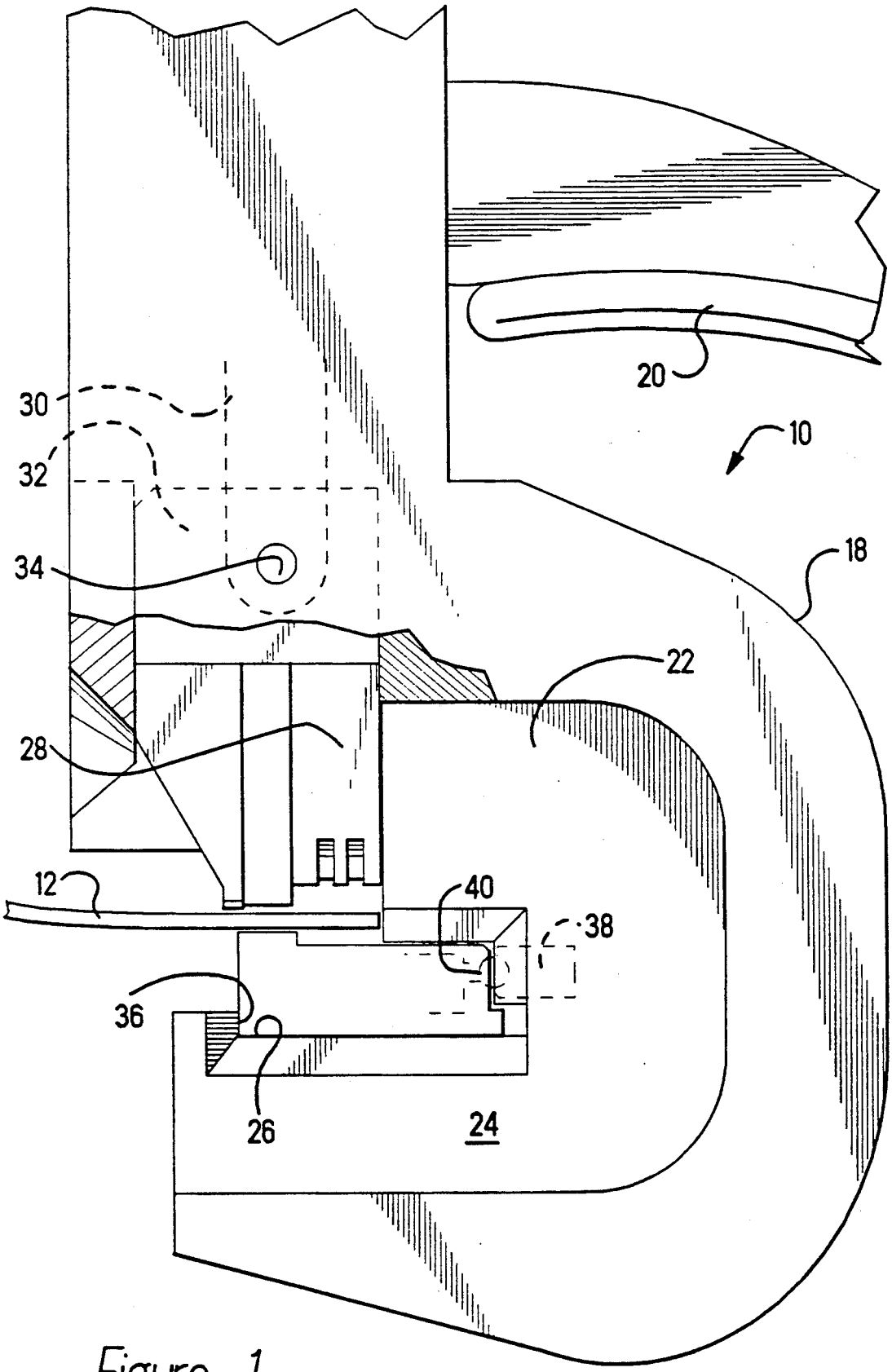
FIG. 1 is a side view of a hand tool incorporating the teachings of the present invention.
Figure 2:
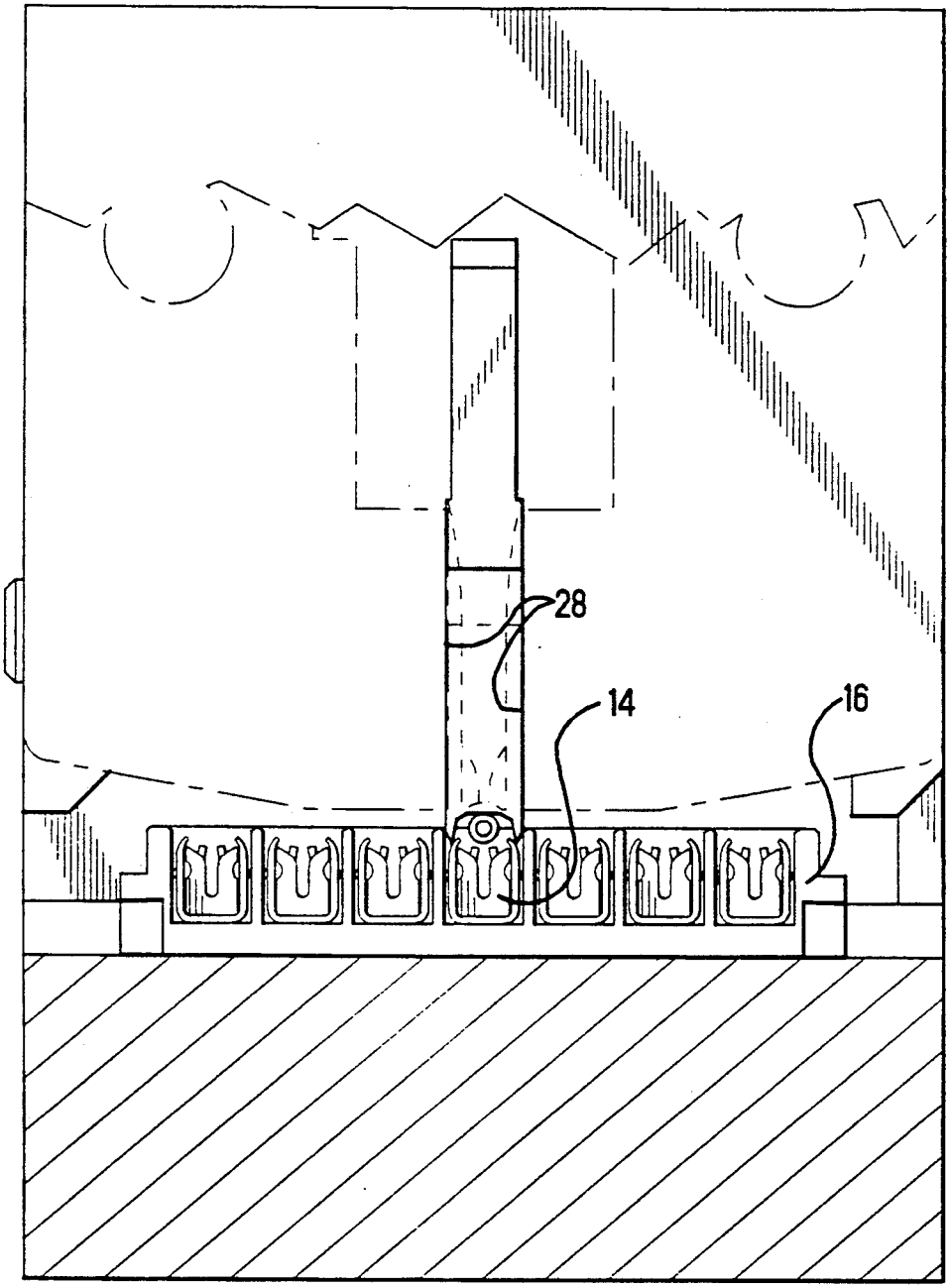
FIG. 2 is a front view of the tool shown in FIG. 1.

There is shown in FIGS. 1 and 2 a hand tool 10 for inserting a wire 12 into an insulation displacement contact 14 contained in a connector housing 16. The hand tool 10 includes a frame 18 and a manually actuatable handle 20. A tooling module 22 is positioned within the frame 18 as shown in FIGS. 1 and 2. The tooling module 22 includes a C-shaped base 24, a track 26 for receiving the connector housing 16, and an insertion blade 28 positioned within a slot formed within the base 24. The insertion blade 28 is arranged to undergo reciprocating motion toward and away from a connector housing positioned within the track. A ram 30, actuated by the handle 20, is attached to the shank 32 of the insertion blade 28 by means of the pin 34. By manually actuating the handle 20, the ram 30 causes the insertion blade 28 to undergo its reciprocating motion.

The track 26 includes a forward banking surface 36 against which the connector housing 16 is urged by a spring biased ball detent unit 38 which is threaded into a hole in the base 22. The ball 40 of the ball detent unit 38 is arranged to engage features on the edge of the connector housing 16 to bring a selected contact 14 into approximate alignment with the insertion blade 28. In the present example the connector housing 16 is a receptacle housing which mates with a plug. Holes in the receptacle housing, which are to receive the pins of the mating plug, are the features engaged by the ball 40, there being one such hole for each contact 14. While the spacing of these holes is substantially identical with the spacing of the contacts 14, it is difficult to accurately align each individual contact 14 with the insertion blade 28 only by means of the ball detent engaging the hole and urging the connector housing against the banking surface 36. This difficulty, as set forth above, is mainly caused by manufacturing tolerances and the inevitable dimensional variations of the plastic connector housing 16. Other similar features may be engageable by the ball detent unit 38, however, they too will only approximately align the selected contact 14 with the insertion blade 28.

Figure 5:
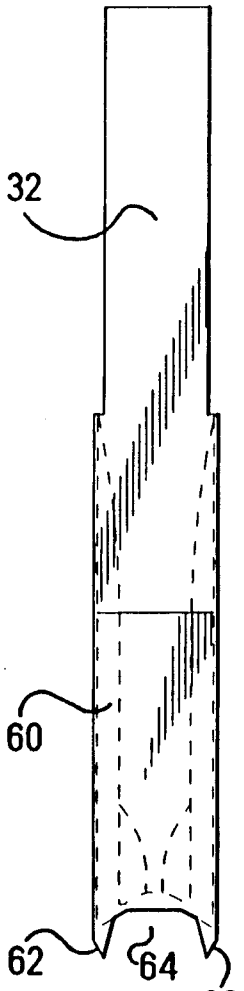
FIGS. 3, 4, and 5 are side, rear, and front views respectively of the inserter and alignment means of the hand tool shown in FIG. 1.
Figure 4:
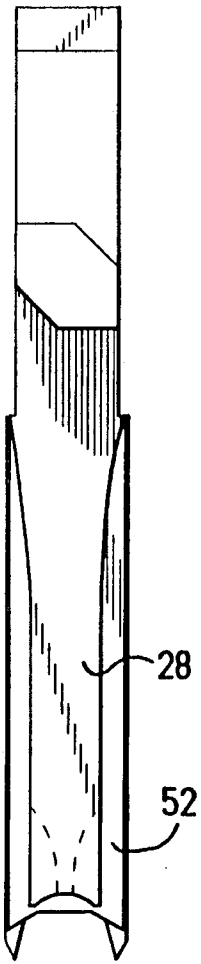
Figure 3:
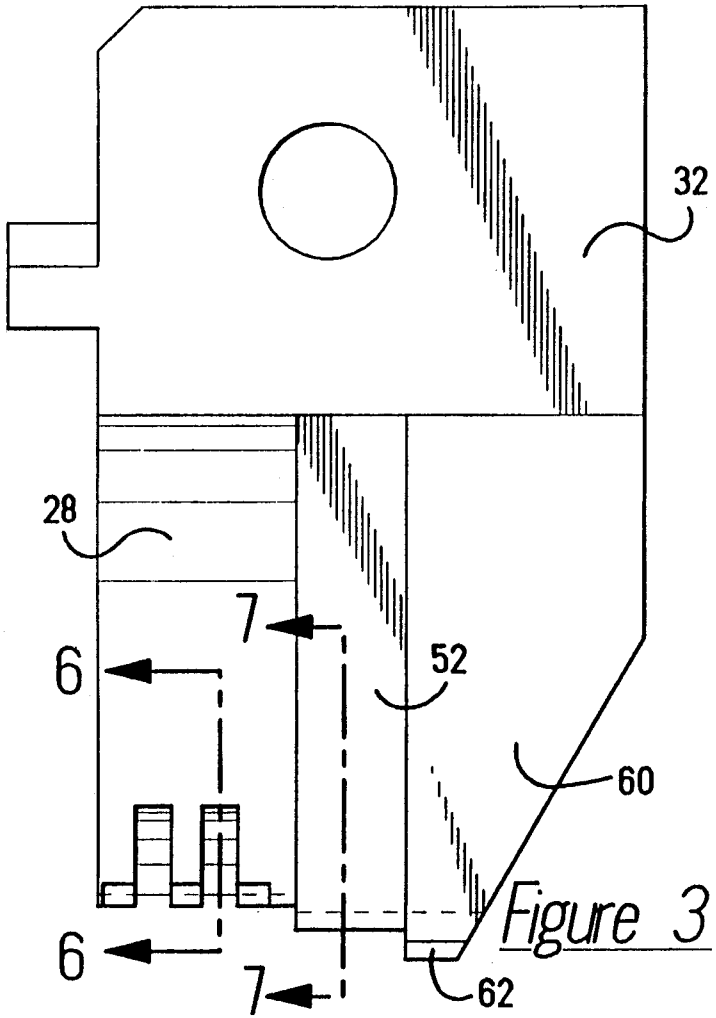
Figure 6:
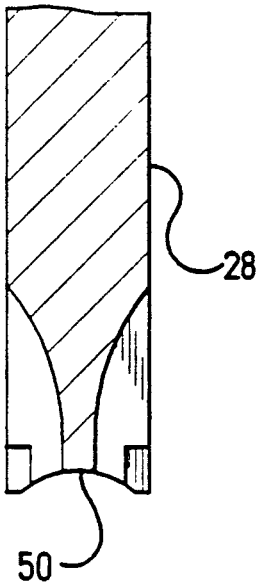
FIGS. 6 and 7 are cross-sectional views taken along the lines 6—6 and 7—7 respectively in FIG. 3.
Figure 7:
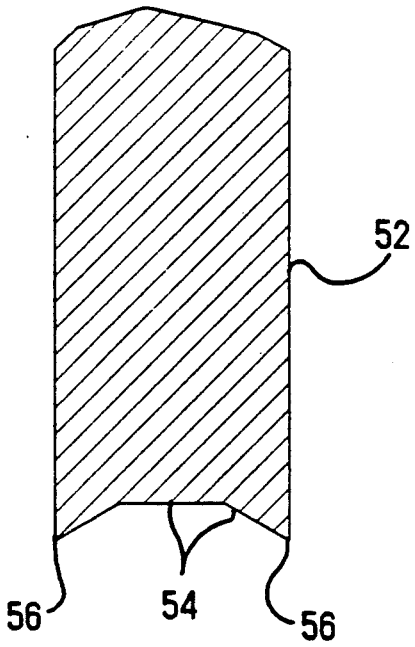

The insertion blade 28 and associated shank 32 are shown in FIGS. 3, 4, and 5. As is best seen in FIG. 6, the insertion blade 28 has the usual cross-sectional shape with a wire engaging and inserting surface 50. An insulation crimping blade 52 is attached to the shank 32 adjacent the insertion blade 28 as shown in FIG. 3 and has a crimping surface 54 as best seen in FIG. 7. The crimping surface 54 terminates in somewhat sharp edges 56. The insulation crimping blade 52, as will be described below, is used to crimp strain relief tabs, which are formed as part of the contact, around the insulation of the wire as the wire is inserted into the contact. A connector alignment member 60 is attached to the shank 32 adjacent the crimping blade 52 as shown in FIG. 3. The alignment member 60 has a pair of camming surfaces 62 which are on opposite sides of the member 60 and which extend further away from the shank 32 than do the crimping surface 54 and the inserting surface 50. The purpose of these camming surfaces 62, as will be explained below, is to further align the connector housing 16. The insertion blade 28, crimping blade 52, and alignment member 60 may be of unitary construction with the shank 32, as in the present example, however, they may be separate pieces suitably attached to the shank 32 so that all three reciprocate together when the handle 20 is actuated. The alignment member 60 includes a clearance cutout 64 so that it does not interfere with the wire 12 during insertion.

Figure 9:
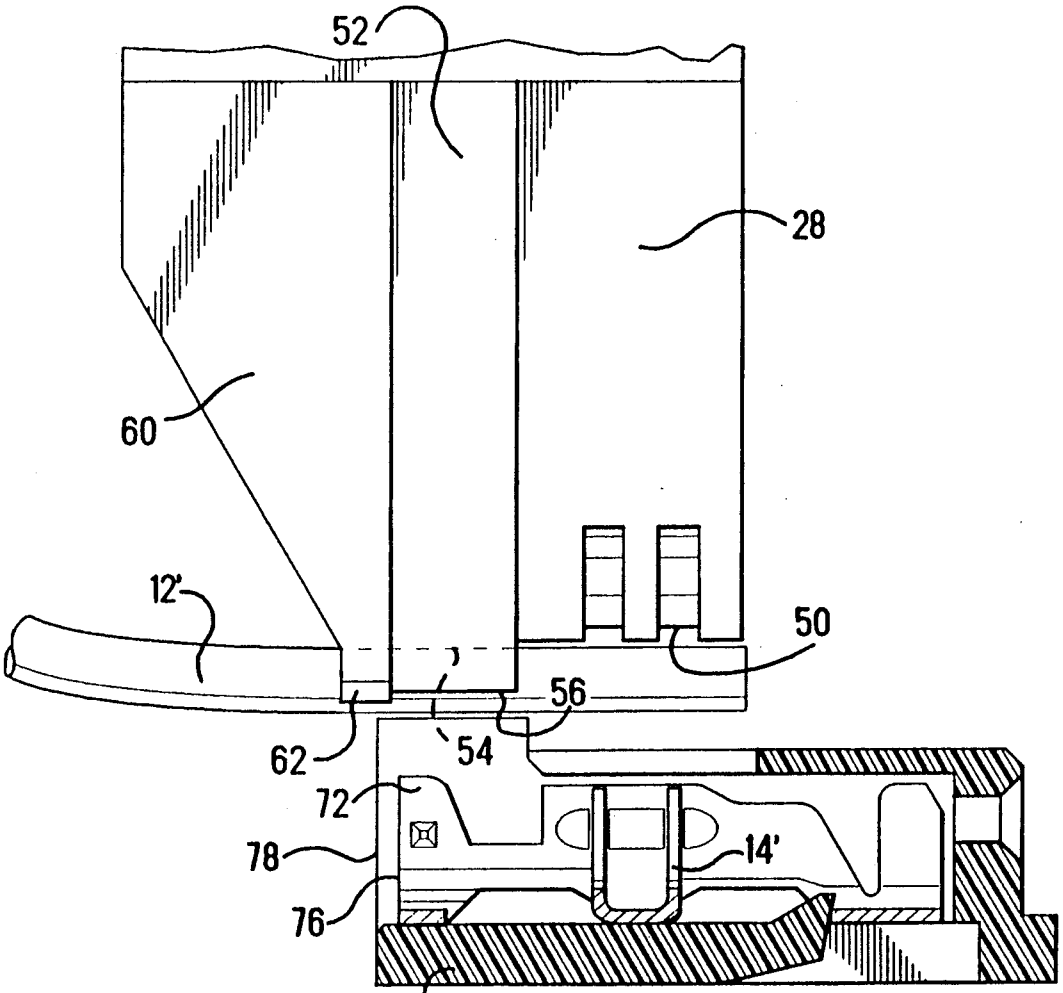
FIG. 9 is a partial cross-sectional view taken along the lines 9—9 of FIG. 8.
Figure 8:
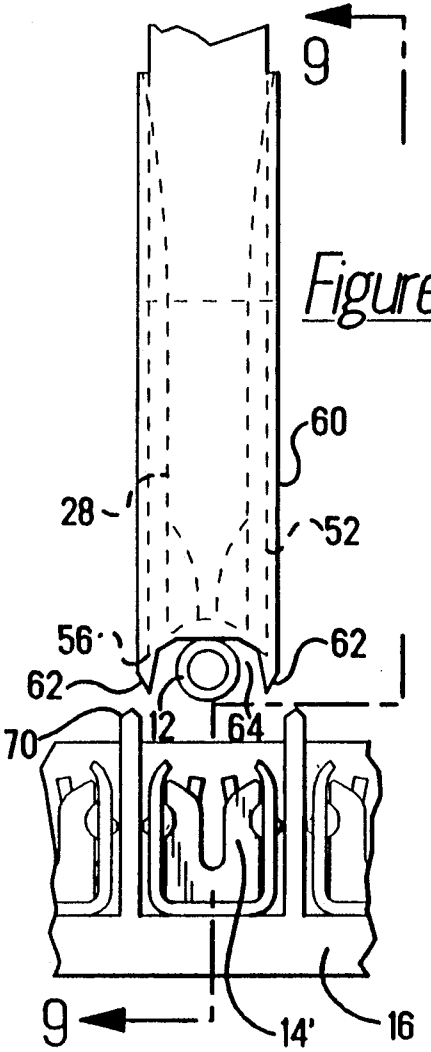
FIG. 8 is a front view of the inserter of FIG. 3 prior to engaging a connector housing.

FIGS. 8 and 9 show an enlarged view of the insertion blade 28, crimping blade 52 and alignment member 60 about to insert a wire 12' into the contact 14' of the connector housing 16. Note that the connector housing 16 is slightly out of alignment with the crimping blade 52, as viewed in FIG. 8. The misalignment, if not corrected, would result in the sharp edge 56 damaging the wall 70 of the connector housing 16. This is avoided by the camming surface 62 engaging the wall 70 in advance of the crimping blade 52 and insertion blade 28 thereby causing the connector housing to move slightly to the left, as viewed in FIG. 8, so that the contact 14' is in engageable alignment with the two blades 52 and 28. Occasionally, the walls 70 on either side of the contact 14' are bowed inwardly. This situation is corrected by the two oppositely disposed camming surfaces 62, each engaging its respective adjacent wall 70 and spreading the two walls apart sufficiently for the crimping blade 52 to enter without damaging either of the walls. As the alignment member 60 enters between the two walls 70, the crimping blade engages and crimps the tabs 72 about the wire 12' and the insertion blade 28 inserts the wire into the insulation displacement contact 14' in the usual manner. The opening 64 in the alignment member 60 prevents bending or kinking of the wire 12' during insertion. As best seen in FIG. 9, the edge 76 of the tab 72 is very close to the edge 78 of the connector housing 16, there being only about 0.015 inch spacing. Care must be taken to assure that the alignment member 60 remains within that 0.015 inch space without engaging the tab 72 since such engagement would damage the connector and possibly damage the tooling.

An important advantage of the present invention is that wires may be safely inserted into closely spaced insulation displacement contacts without damage to the adjacent connector housing walls that separate the contacts due to misalignment of the connector housing. Additionally, when the housing walls on either side of a contact are warped or bowed toward each other, the alignment member will move the walls sufficiently into alignment so that wire insertion may be completed without damage to the housing walls.

What is claimed is:

1. In an apparatus for inserting an insulated wire into an insulation displacement contact in a connector housing, including a track for receiving said connector housing, inserter means for inserting said wire into said contact, and means for initially positioning said housing so that said contact is in approximate alignment with said inserter means, alignment means for further positioning said housing so that said contact is in engageable alignment with said inserter means and said housing remains substantially free of engagement with said inserter means during insertion of said wire into said contact, said alignment means including a guide member having a camming surface arranged to move with and in advance of said inserter means and to cammingly engage said housing thereby effecting said further positioning of said housing prior to insertion of said wire into said contact.

2. The apparatus according to claim 1 wherein said guide member includes a pair of camming surfaces arranged on opposite sides thereof to cammingly engage the walls of said housing on opposite sides of said contact.

3. The apparatus according to claim 2 wherein said guide member includes an opening in one end thereof between said pair of camming surfaces, said opening arranged to provide clearance for said wire during insertion of said wire into said contact.

4. The apparatus according to claim 1 wherein said inserter means includes a blade for inserting said wire into said contact and a crimper for crimping a portion of said contact about a portion of the insulation of said wire to form a strain relief and wherein said guide member is attached to said crimper on a side opposite that of said blade.

5. The apparatus according to claim 4 wherein said blade, said crimper, and said guide member are of unitary construction.

* * * * *